US008403250B1

(12) United States Patent
Callahan

(10) Patent No.: US 8,403,250 B1
(45) Date of Patent: Mar. 26, 2013

(54) HOSE REEL

(76) Inventor: Thomas A. Callahan, St. Petersburg, FL (US)

( * ) Notice: Subject to any disclaimer, the term of this patent is extended or adjusted under 35 U.S.C. 154(b) by 178 days.

(21) Appl. No.: 12/456,084

(22) Filed: Jun. 11, 2009

Related U.S. Application Data

(60) Provisional application No. 61/131,663, filed on Jun. 11, 2008.

(51) Int. Cl.
*B65H 75/40* (2006.01)

(52) U.S. Cl. ..... 242/403.1; 242/533.8; 242/557; 137/355.26

(58) Field of Classification Search ..... 242/403, 242/403.1, 533.8, 557; 137/355.26–355.28
See application file for complete search history.

(56) References Cited

U.S. PATENT DOCUMENTS

| | | | | | |
|---|---|---|---|---|---|
| 549,202 | A | * | 11/1895 | Landon | 242/403.1 |
| 818,878 | A | | 4/1906 | Eichhoff | |
| 828,562 | A | | 8/1906 | Melven | |
| 1,221,099 | A | | 4/1917 | Sherwood et al. | |
| 2,512,756 | A | * | 6/1950 | Wasserman | 242/397.4 |
| 2,518,990 | A | * | 8/1950 | Keener | 137/355.2 |
| 2,590,963 | A | * | 4/1952 | Hannay | 242/403.1 |
| 2,595,655 | A | | 5/1952 | Hannay | |
| 4,137,939 | A | | 2/1979 | Chow | |
| 4,228,553 | A | | 10/1980 | Genuit | |
| 4,700,737 | A | * | 10/1987 | Nelson | 137/355.27 |
| 5,109,882 | A | | 5/1992 | Eley | |
| 5,462,298 | A | * | 10/1995 | Bodine | 280/47.34 |
| 5,622,319 | A | | 4/1997 | Babb et al. | |
| 6,386,473 | B1 | | 5/2002 | Vitaletti | |
| 6,851,640 | B2 | | 2/2005 | Massaro | |
| D547,021 | S | * | 7/2007 | Stein | D34/17 |
| D604,020 | S | * | 11/2009 | Blaszczak et al. | D34/14 |

* cited by examiner

*Primary Examiner* — Sang Kim
(74) *Attorney, Agent, or Firm* — Frijouf, Rust & Pyle, P.A.

(57) ABSTRACT

A hose reel device is disclosed for supporting and transporting a hose. The hose reel device comprises a frame. A support beam extends within the frame. A spool includes a hub interposed between a first flange plate and a second flange plate for winding the hose on the spool. The hub of the spool rotatably engages the support beam for rotating the spool relative to the frame. The hub of the spool and the frame define a perpendicular angle. A wheel rotatably engages the frame for transporting the hose reel device over a surface in an oblique position and pivoting the spool between a horizontal position and a vertical position relative to the surface. The horizontal position defines a first optimal position for winding the hose about the spool. The vertical position defines a second optimal position for propelling a fluid between a holding tank and a storage tank.

13 Claims, 7 Drawing Sheets

HOSE REEL

CROSS-REFERENCE TO RELATED APPLICATIONS

This application claims benefit of U.S. Patent Provisional application Ser. No. 61/131,663 filed Jun. 11, 2008. All subject matter set forth in provisional application Ser. No. 60/131,663 is hereby incorporated by reference into the present application as if fully set forth herein.

BACKGROUND OF THE INVENTION

1. Field of the Invention

This invention relates to dispensing and positioning device and more particularly to the hose reel device for dispensing and positioning a hose.

2. Background of the Invention

The problem of hose utilization, retrieval and storage for re-use has been addressed by the prior art. The general approach to this problem has been to provide a reel, a support for the reel, and a means to rotate the reel. A more significant improvement included the ability to attach a first end of the hose to the reel while providing a non-rotating connection in communication with the first end of the hose, thereby providing the ability to utilize the hose when partially unwound from the reel.

Hoses used with hose reels may have the fluid passed therethrough under a positive pressure, as in a common garden hose attached to a water spigot. Alternately, the hoses may have fluid passed therethrough as the result of a vacuum or reduced pressure applied to the hose, as in the case of a swimming pool skimmer, a vessel holding tank pump out station, or a septic tank pump out unit. While the fluid pumped through the swimming pool skimmer is substantially totally liquid, the material pumped through the vessel holding tank or septic tank contains solid material in addition to fluid. Hose reels of the prior art have not considered the hydraulic consequences of fluids containing solid material and suspended solids effectively increasing the fluid viscosity. Settling of fluids and solid matter in the lower sections of the hose on hose reels effectively increases the hydraulic loads on the pumps, especially on restart following useage. These issues have not been adequately addressed by the prior art.

U.S. Pat. No. 818,878 to Eichoff discloses a wire-reel for winding and unwinding any kind of wire. The reel is provided with a means for mounting the reel to the end that it may be adjusted to a variety of positions, whereby the reel is adapted to rotate in a vertical plane or in a horizontal plane or in an inclined plane, and provision is made for overcoming a tendency of the reel and its mount to tip or fall over when the structure is used on a hillside.

U.S. Pat. No. 828,562 to Melven discloses hose-reel for holding water-hose when not in use. One of the principal objects is to provide a novel and simple structure upon which hose may be readily wound and which can be so placed that the water will drain completely from the hose. A further object is to provide a collapsible or knockdown structure that will when taken apart occupy comparatively little space, so that it may be more compactly shipped or stored.

U.S. Pat. No. 2,595,655 to Hannay discloses a hose reel which can be produced at comparatively low cost, which is strong, light and durable, which supports the hose when the same is wound thereon in such position that the several windings thereof are separated from each other and can dry out rapidly, which can be conveniently supported either in a horizontal position for winding or unwinding the hose or in a vertical position so that the same occupies less space for storing purposes, and which when arranged in a horizontal position upon the lawn or ground will be securely held against U.S. Pat. No. 4,137,939 to Chow discloses a portable hose reel cart comprising a cart frame, a rotatable reel, and wheels secured to said frame. The frame comprises a handle portion, a support portion, and a pair of angled intermediate portions disposed on opposite sides of the frame and connecting the handle and support portions. The reel is secured to the frame and adapted for rotation about an axis intersecting the intermediate portions, and the wheels are adapted to form with the support a stable base for the frame. The resultant cart is movable to a first stable and generally upright reeling position wherein the frame is supported by the wheels and support portion, a second stable and generally horizontal unreeling position wherein the frame is supported by both the handle and support portions with the reel being free for rotation and a third unstable transporting position wherein the frame is sup-ported essentially by only the wheels of the cart.
displacement thereon so as to not injure the lawn.

U.S. Pat. No. 4,228,553 to Genuit discloses a portable or stationary apparatus incorporating a reel for storage of the swimming pool vacuum hose and a means for submerging the hose as it is unwound into the pool, assuring thereby the filling of the hose with water coincident with its being dispensed into the pool. The evacuation of air from the hose permits the immediate connection of the hose to the vacuum pump without causing the pump to lose its prime.

U.S. Pat. No. 5,109,882 to Eley discloses a hose reel inclu-ings a reel member rotatably mounted on a horizontal portion of an upstanding tube. The up-standing tube extends vertically from the horizontal portion and thence diagonally, to a lower vertical portion aligned generally under the center of the reel member. The lower end of the upstanding tube is rotatably mounted to one end of a support arm so that the reel and upstanding tube member combination will rotate around a vertical axis. The support arm extends a distance permitting complete rotation of the reel and up-standing tube, and has a short depending arm which is slidably mounted within a tubular support. A flexible hose is inserted through the upstanding tube, and has a swivel valve connected to the lower end thereof and a second swivel valve connected to the upper end thereof, to supply fluid to a hose on the reel while permitting full rotation of the reel member as well as rotation of the upstanding tube on the support arm. A generally U-shaped rod member extends parallel to the reel hub and has its legs rotatably connected to the horizontal portion of the upstanding tube so as to rotate around the longitudinal axis of the hub, to act as a hose guide.

U.S. Pat. No. 5,622,319 to Babb et al. discloses a portable water jetting apparatus comprising a longitudinally collapsible can having wheels at one end and a handle at the other, a water jetter unit removably mounted on the can adjacent the wheeled end thereof, and a jetter hose reel unit mounted on the can adjacent the handle end thereof. Both the water jetter unit and hose reel unit are adapted to be quickly and selectively disconnected from the can to facilitate use, transportation, and/or storage of the apparatus, and the hose reel unit is pivotally mounted on the cart for selective orientation of the reel is relative to the can and thus the direction of winding or unwinding of the jetter hose therefrom during use of the apparatus.

U.S. Pat. No. 6,386,473 to Vitaletti discloses a storage device for a long vacuum hose such as used for cleaning a pool having a frustoconcial member mounted on a reel rotatably supported on a frame. The frustoconical member frictionally fits and secures the end of the vacuum hose to enable the winding of the hose on the reel U.S. Pat. No. 6,851,640 to Massaro discloses a hose reel suitably having a hub mounted on a frame to accept an air hose, said hub being rotatable to wind the air hose. Wheels are attached to one end of the frame and at least one leg is affixed to the back of the frame. The leg enables the frame to be stable when it is rotated 90° off the wheels and onto the leg.

Although these devices of the prior art have made contributions to the art, none has adequately addressed all the existing deficiencies in current devices.

Therefore it is an object of this invention to provide a hose reel system which overcomes the deficiencies of the devices of the prior art.

Another object of this invention is to provide a hose reel device which overcomes the hydraulic deficiencies of the prior art.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a hose reel device for supporting and transporting a first hose over a surface. The first hose extends between a holding tank and the hose reel device. A second hose extends between the hose reel device and a storage tank. The holding tank houses a fluid. A pump engages the fluid for propelling the fluid between the holding tank and the storage tank. The hose reel device comprises a frame including a lower beam, a upper beam, a first coupling beam interposed between the lower beam and the upper beam and a second coupling beam interposed between the lower beam and the upper beam. A support beam extends within the frame. A spool includes a hub interposed between a first flange plate and a second flange plate for winding the first hose on the spool. The hub of the spool rotatably engages the support beam for rotating the spool relative to the frame. A hose input traverses the hub of the spool for engaging the first hose. A hose output traverses the first flange plate for engaging the second hose. A conduit extends between the hose input and the hose output for conveying the fluid between the first hose and the second hose. The hub of the spool and the frame define a perpendicular angle. A wheel rotatably engages the lower beam for transporting the hose reel device over the surface in an oblique position and pivoting the spool between a horizontal position and a vertical position relative to the surface. The horizontal position defines a first optimal position for winding the first hose about the spool. The vertical position defines a second optimal position for propelling the fluid between the holding tank and the storage tank.

In a more specific embodiment of the invention, a handle extends from the upper beam for griping the frame and supporting the frame when the spool is in the vertical position relative to the surface. The handle includes a polymer cap for increasing the friction coefficient between the handle and the surface to prevent displacement of the hose reel device relative to the surface when the spool is positioned in the vertical position.

In one embodiment of the invention, a lower ledge extends from the lower beam. The lower ledge includes a first lower ledge beam, a second lower ledge beam and a lower coupling ledge beam interposed between the first lower ledge beam and the second lower ledge beam. The lower ledge and the frame define a first generally L-shape. An upper ledge extends from the frame. The upper ledge includes a first upper ledge beam, a second upper ledge beam and a upper coupling ledge beam interposed between the first upper ledge beam and the second upper ledge beam. The frame, the support beam and the upper ledge define a second generally L-shape. A first bearing is secured to the support beam. A second bearing is secured to the upper coupling ledge beam. The first bearing and the second bearing define a concentric alignment. A spool axle traverses between the first bearing and the second bearing for rotating the spool axle relative to the frame. The spool axle traverses the hub of the spool for rotating the spool upon rotation of the spool axle. A leg extends from the lower ledge for supporting the spool above the surface. The leg and the ledge define a perpendicular angle. A column extends between the upper ledge to the lower ledge for transmitting a vertical load of the spool from the upper ledge through the leg and to the surface when the spool is positioned in the horizontal position.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
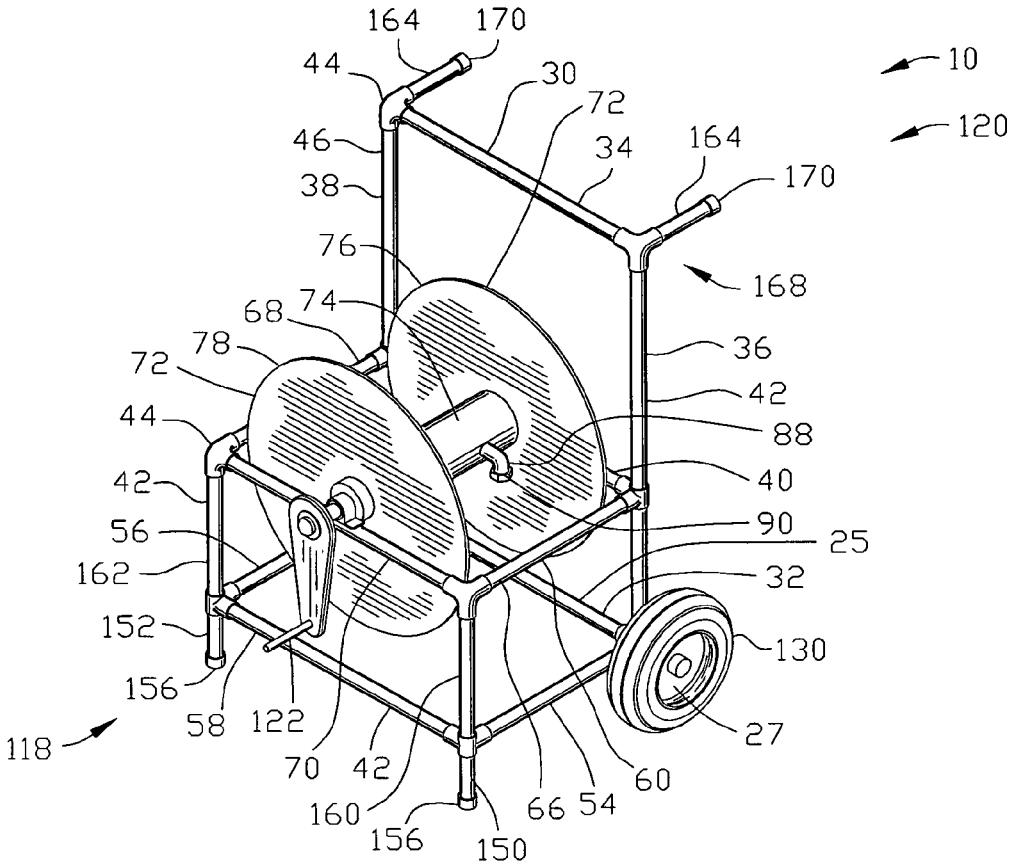
FIG. 1 is an isometric view of a hose reel device of the present invention.
Figure 2:
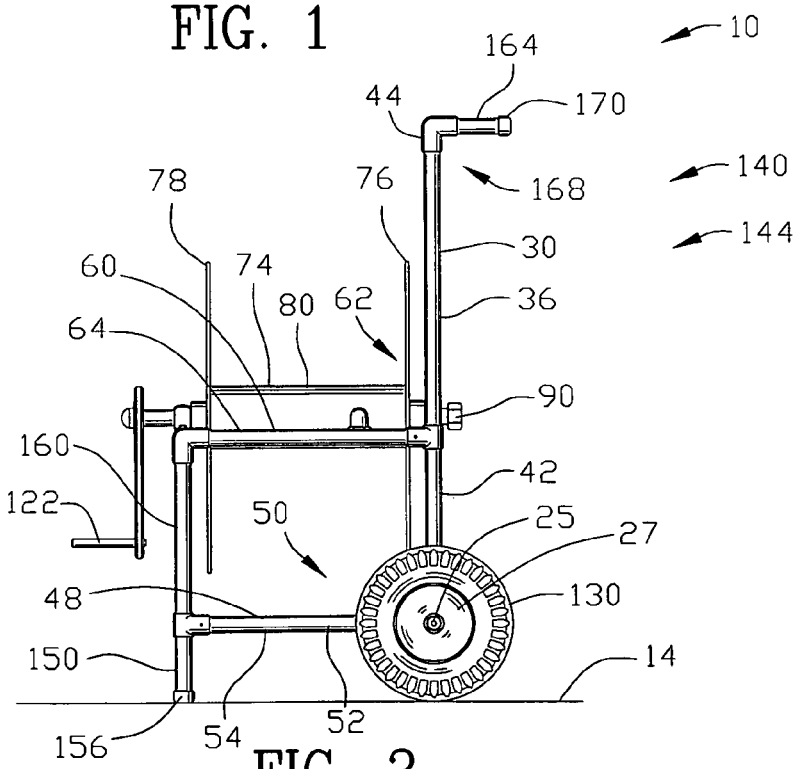
FIG. 2 is a side view of FIG. 1.
Figure 3:
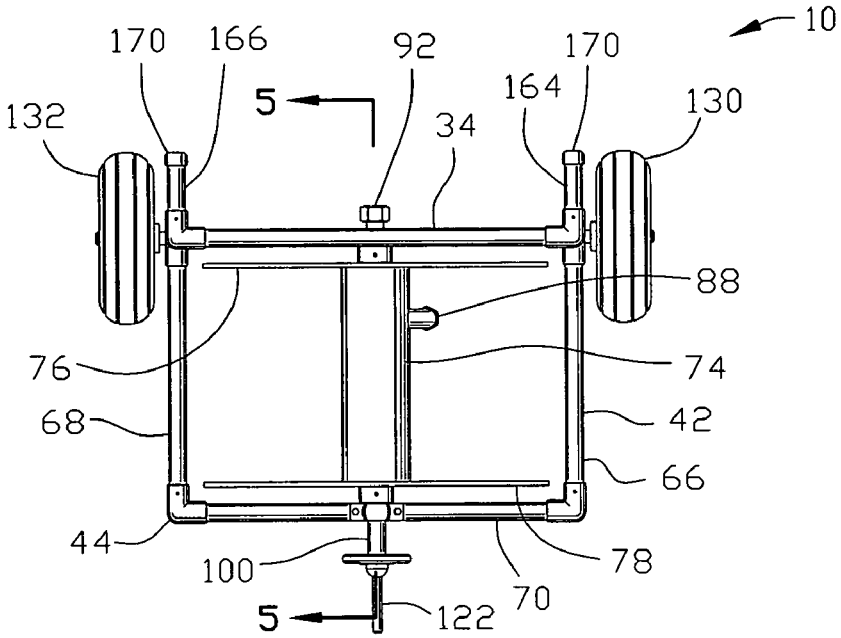
FIG. 3 is a bottom view of FIG. 1.
Figure 4:
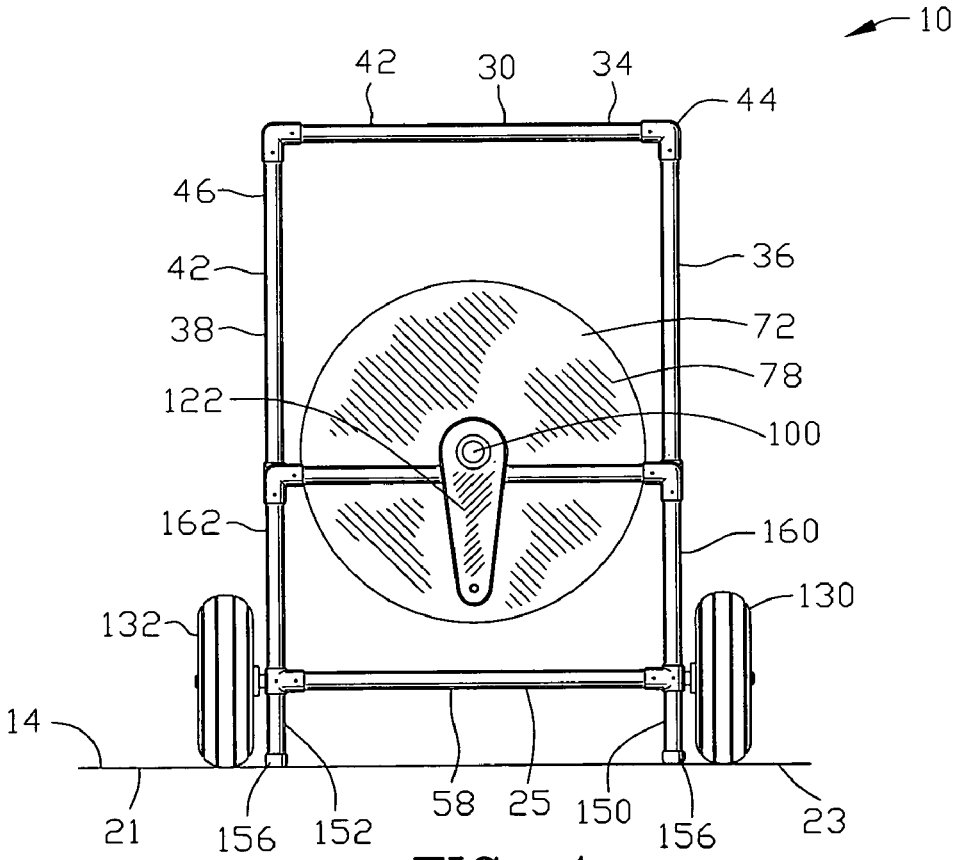
FIG. 4 is a rear view of FIG. 1.
Figure 5:
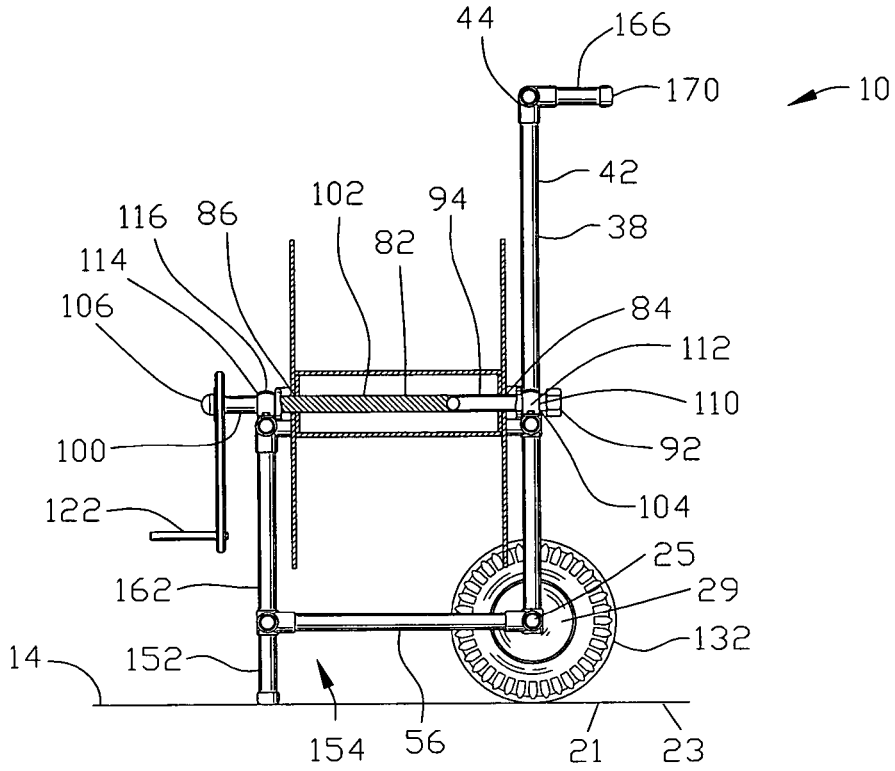
FIG. 5 is a sectional view along line 5-5 in FIG. 3.
Figure 6:
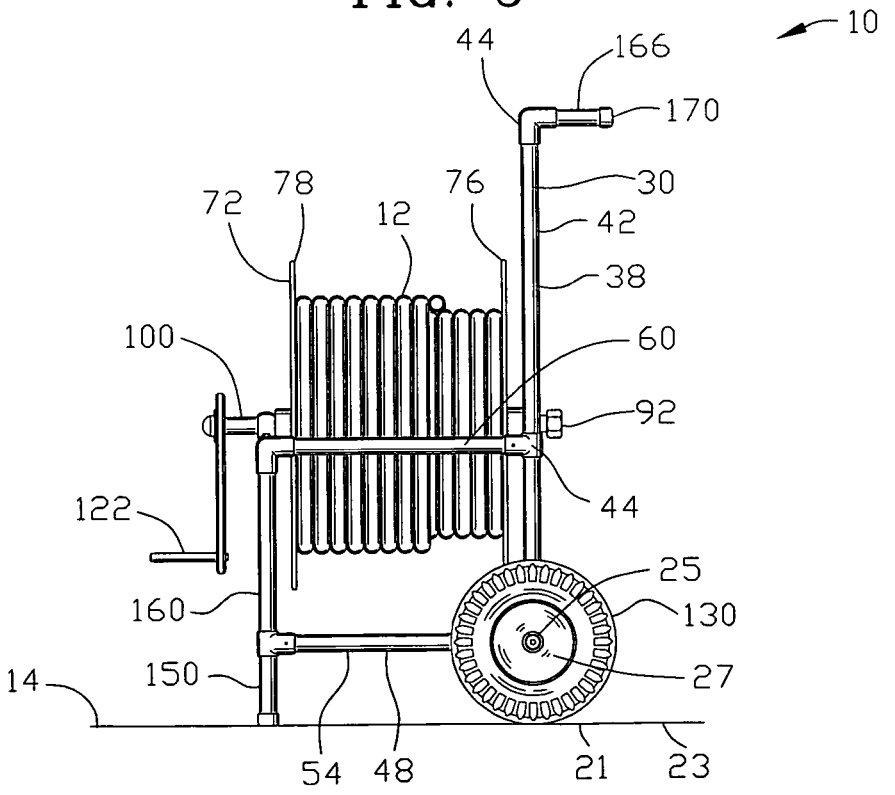
FIG. 6 is a side view similar to FIG. 2 illustrating a hose engaging the hose reel.

FIGS. 1 thru 12 are various views of a hose reel device 12 for supporting and transporting a first hose 12 over a surface 14. The first hose 12 extends between a holding tank 16 and the hose reel device 12. A second hose 18 extends between the hose reel device 12 and a storage tank 20. The holding tank 16 houses a fluid 22. A pump 24 engages the fluid 22 for propelling the fluid 22 between the holding tank 16 and the storage tank 20. The first hose 12 and the second hose 18 may include reinforced sidewalls 26 such that upon an interior atmospheric pressure below the exterior atmospheric pressure the first hose 12 and the second hose 18 will not collapse upon itself. The pump 24 may include an internal gear pump, an external gear pump, rotary lobe pump, a vane pump or other fluid pumps 28. The pump 24 is shown to be linked within the second hose 18. Alternatively, the pump 24 may be integral with the storage tank 20, linked within the first hose 12 or be integral with the holding tank 16.

The hose reel device 12 comprises a frame 30 including a lower beam 32, an upper beam 34, a first coupling beam 36 interposed between the lower beam 32 and the upper beam 34. A second coupling beam 38 is also interposed between the lower beam 32 and the upper beam 34. A support beam 40 extends within the frame 30. The frame 30 may be constructed from galvanized cylindrical tubing 42. The lower beam 32, the upper beam 34, the first coupling beam 36 and the second coupling beam 38 are shown to be secured together by galvanized cylindrical tube couplers 44. Alternatively, the frame 30 may be constructed from an integral one piece unit 46.

The frame 30 may further include a lower ledge 48 that extends from the lower beam 34. Preferably, the lower beam 34 defines a perpendicular angle 50 with the frame 30. The lower ledge 48 and the frame 30 define a first generally L-shape 52. The lower ledge 48 includes a first lower ledge beam 54, a second lower ledge beam 56 and a lower coupling ledge beam 58 interposed between the first lower ledge beam 54 and the second lower ledge beam 56. The lower ledge 48 may be constructed from galvanized cylindrical tubing 42. The first lower ledge beam 54, the second lower ledge beam 56 and the lower coupling ledge beam 58 are shown to be secured together by galvanized cylindrical tube couplers 44. Alternatively, the lower ledge 48 may be constructed from an integral one piece unit 46.

The frame 30 may further include an upper ledge 60 that extends from the frame 30. Preferably, the upper beam 60 defines a perpendicular angle 62 with the frame 30. The upper ledge 60, the support beam 40 and the frame 30 define a second generally L-shape 64. The upper ledge 60 includes a first upper ledge beam 66, a second upper ledge beam 68 and a upper coupling ledge beam 70 interposed between the first upper ledge beam 66 and the second upper ledge beam 68. The upper ledge 60 may be constructed from galvanized cylindrical tubing 42. The first upper ledge beam 66, the second upper ledge beam 68 and the upper coupling ledge beam 70 are shown to be secured together by galvanized cylindrical tube couplers 44. Alternatively, the upper ledge 60 may be constructed from an integral one piece unit 46.

The upper ledge 60 supports a spool 72 that dispensing and positioning the first hose 12. A spool 72 includes a hub 74 interposed between a first flange plate 76 and a second flange plate 78 for winding the first hose 12 on the spool 72. The hub 74 defines a cylindrical body 80 having an interior bore 82. The interior bore 82 extends between a first aperture 84 and a second aperture 86. A spool axle 100 traverses within the interior bore 82 of the hub 74 and extends passed both of the first flange plate 76 and the second flange plate 78. The spool axle 100 may be affixed to the hub 74 by weld, keying, gluing or other fastening means. The spool axle 100 defines an interior passage 102. The interior passage 102 extends between a first hole 104 and a second hole 106.

The spool 72 includes a hose input 88 for engaging the first hose 12. The hose input 88 traverses the hub 74 and the spool axle 100 for conveying the fluid 22 into the interior passage 102 of the spool axle 100. The hose input 88 may include a female threaded coupler 90 for threadably receiving a male threaded end 13 of the first hose 12. The spool 72 further includes a hose output 92 for engaging the second hose 18. The hose output 92 traverses the first hole 104 of the spool axle 100 for removing the fluid 22 from the interior passage 102 of the spool axle 100. The hose output 92 many also include a female threaded coupler 90 for threadably receiving a male threaded end 13 of the second hose 18. A conduit 94 extends between the hose input 88 and the hose output 92 for conveying the fluid 22 between the hose input 88 and the hose output 92.

A first bearing 110 is secured to the support beam 40 of the frame 30 by a first U-shaped anchor 112. A second bearing 114 is secured to the upper coupling ledge beam 70 by a second U-shaped anchor 116. The first bearing 110 and the second bearing 114 define a concentric alignment 118. The spool axle 100 traverses the first bearing 110 and the second bearing 114 for rotating the spool 72 relative to the frame 30. The concentric alignment 118 results in a perpendicular angle 120 between the hub 74 of the spool 72 and the frame 30. A spool handle 122 is secured to the second hole 106 of the spool axle 100 adjacent to the second flange plate 78 of the spool 72 for rotating the spool 72 relative to the frame 30. The spool handle 122 is utilized for rotating the spool 72 in either a clockwise or a counter-clockwise direction. The rotation of the spool 72 winds or unwinds the first hose 12 around the hub 74 of the spool 72.

A first wheel 130 rotatably engages the lower beam 32 for transporting the hose reel device 10 over the surface 14 in an oblique position 148 and pivoting the spool 72 between a horizontal position 140 and a vertical position 142 relative to the surface 14. A second wheel 132 also rotatably engages the lower beam 32 for transporting the hose reel device 10 over the surface 14 in an oblique position 148 and pivoting the spool 72 between a horizontal position 140 and a vertical position 142 relative to the surface 14.

A first leg 150 extends from the lower ledge 48. A second leg 152 may also extend from the lower ledge 48. The first leg 150 and the second leg 152 support the lower ledge 48 above the surface 14. Preferably, the first leg 150 and the second leg 152 define a perpendicular angle 154 relative to the lower ledge 48. The first leg 150 and the second leg 152 may be constructed from galvanized cylindrical tubing 42. The first leg 150 and the second leg 152 are shown to be secured together by galvanized cylindrical tube couplers 44. Alternatively, the first leg 150 and the second leg 152 and the lower ledge 48 may be constructed from an integral one piece unit 46.

The first leg 150 and the second leg 152 may include a polymer cap 156. The polymer cap 156 increases the friction coefficient between the first leg 150 and the second leg 152 and the surface 14. The increased coefficient of friction generated by the polymer caps 156, prevent displacement of the hose reel device 10 relative to the surface 14 when the spool 72 is positioned in the horizontal position 140.

A first column 160 extends between the upper ledge 60 to the lower ledge 48. Preferably the first column 160 is aligned with the first leg 150 such that the first column 160 transmits a vertical load of the spool 72 from the upper ledge 60 through the first leg 150 and to the surface 14 when the spool 72 is positioned in the horizontal position 140. A second column 162 extends between the upper ledge 60 to the lower ledge 48. Preferably the second column 162 is aligned with the second leg 152 such that the second column 160 transmits a vertical load of the spool 72 from the upper ledge 60 through the second leg 152 and to the surface 14 when the spool 72 is positioned in the horizontal position 140. Preferably, the first column 160 and the second column 162 define a perpendicular angle 154 relative to the lower ledge 48 and the upper ledge 60. The first column 160 and the second column 162 may be constructed from galvanized cylindrical tubing 42. The first column 160 and the second column 162 are shown to be secured together by galvanized cylindrical tube couplers 44. Alternatively, the first column 160, the second column 162, the lower ledge 48 and the upper ledge 60 may be constructed from an integral one piece unit 46.

A first handle 164 extends from the upper beam 34. A second handle 166 may also extend from the upper beam 34. The first handle 164 and the second handle 166 assist in griping the frame 30. Furthermore, the first handle 164 and the second handle 166 serve to support the frame 30 above the surface 14 when the spool 72 in the vertical position 142 relative to the surface 14. Preferably, the first handle 164 and the second handle 166 define a perpendicular angle 168 relative to the upper beam 34. The first handle 164 and the second handle 166 may be constructed from galvanized cylindrical tubing 42. The first handle 164 and the second handle 166 are shown to be secured together by galvanized cylindrical tube couplers 44. Alternatively, the first handle 164, the second handle 166 and the frame 30 may be constructed from an integral one piece unit 46.

The first handle 164 and the second handle 166 may include a polymer cap 170. The polymer cap 170 increases the friction coefficient between the first handle 164 and the second handle 166 and the surface 14. The increased coefficient of friction generated by the polymer caps 170, prevent displacement of the hose reel device 10 relative to the surface 14 when the spool 72 is positioned in the vertical position 142.

Figure 7:
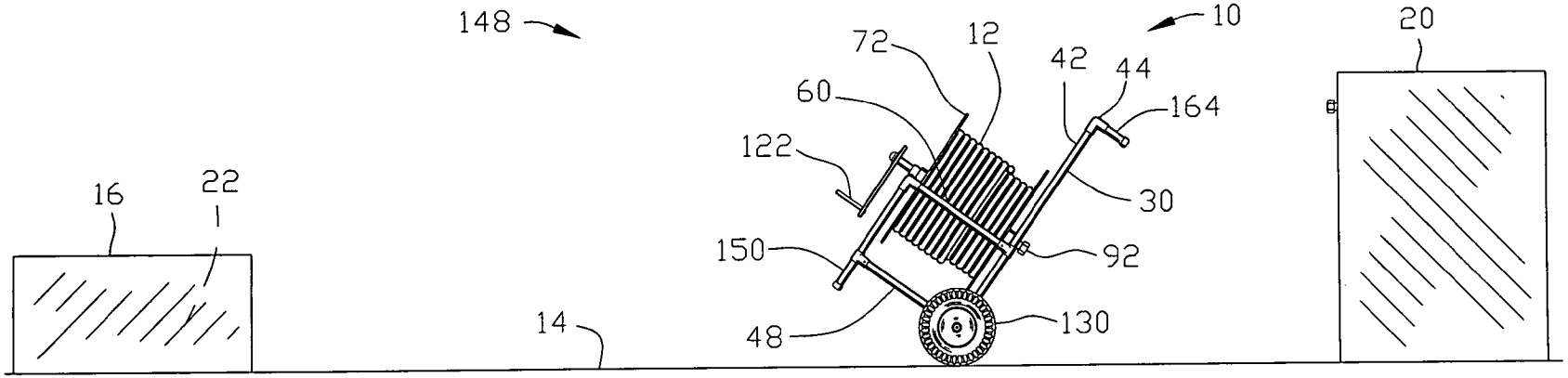
FIG. 7 is a side view similar to FIG. 6 illustrating the hose reel in an oblique position.

FIGS. 7 thru 11 illustrate the steps taken to utilize the hose reel device 10. FIG. 7 illustrates the hose real device 10 in an oblique position 148 for displacing the hose reel device 10 over the surface 14. The first handle 164 and the second handle 166 are utilize to pivot the frame 30 upon the lower beam 32. Upon pivoting of the frame 30 the first leg 150 and the second leg 152 are raised above the surface 14 and thereafter the first wheel 130 and the second wheel 132 support the vertical load of the hose reel device 10.

Figure 8:
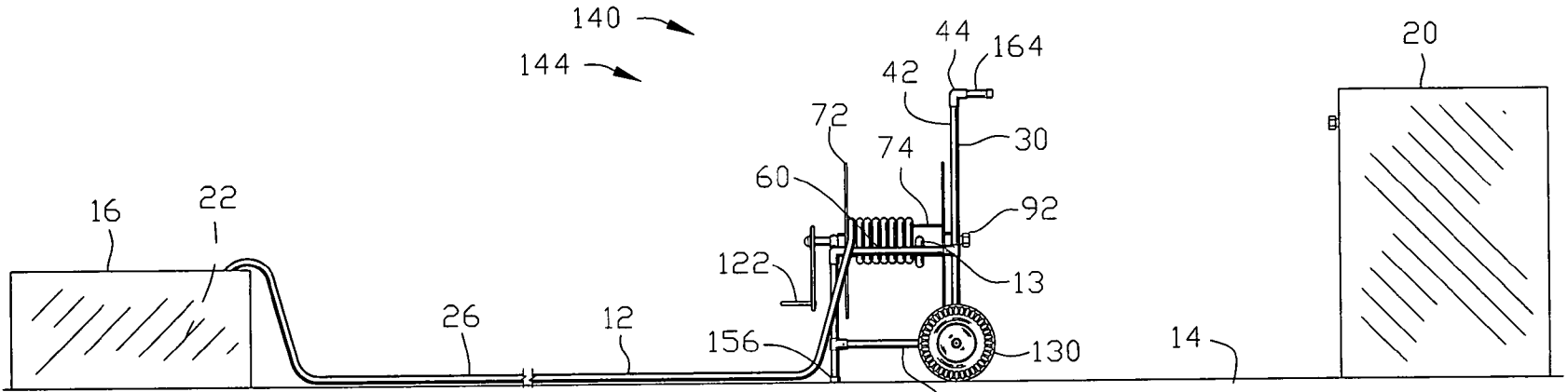
FIG. 8 is a side view similar to FIG. 7 illustrating the hose from the hose reel device engaging a holding tank.
Figure 9:
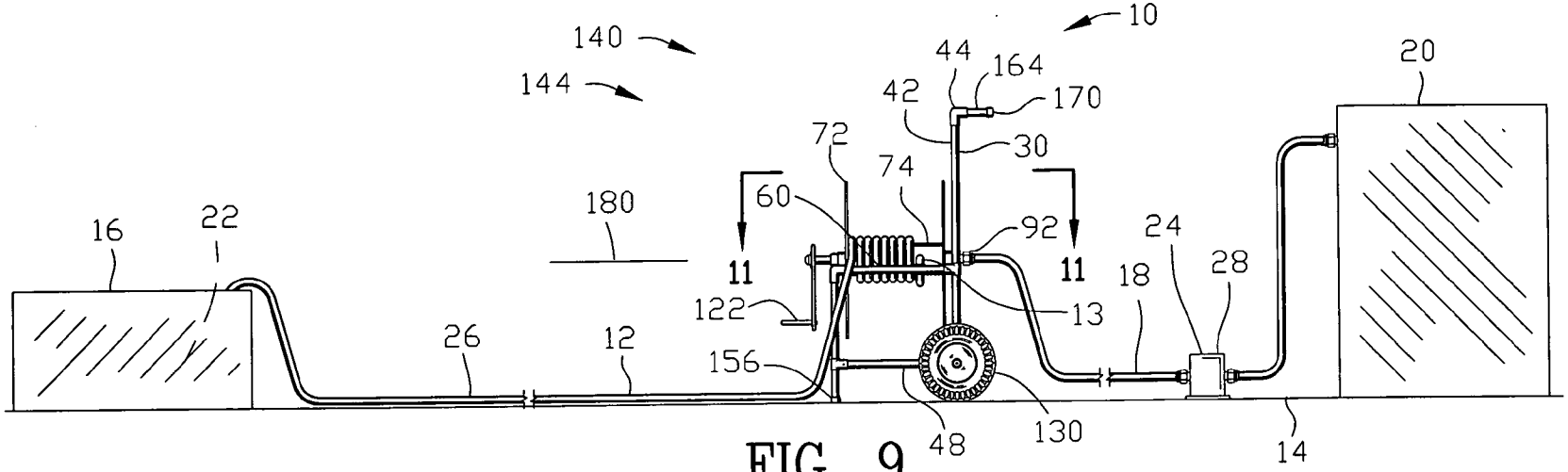
FIG. 9 is a side view similar to FIG. 8 illustrating a suction hose engaging the hose reel device.

FIG. 8 illustrates the hose real device 10 in a first optimal position 144. The first optimal position 144 includes the first leg 150, the second leg 152, the first wheel 130 and the second wheel 132 in contact with the surface. Furthermore, the first optimal position 144 is defined as positioning the spool 72 in a horizontal position 140. The first optimal position 144 is conducive to winding and unwinding the first hose 12 from the spool 72. To unwind the first hose 12, the first hose 12 is pulled away from hub 74 in order to rotate the spool 72 upon the first bearing 110 and the second bearing 114. The first hose 12 is wound upon the hub 74 by utilizing the spool handle 122 in order to rotate the spool 72 upon the first bearing 110 and the second bearing 114.

Figure 11:
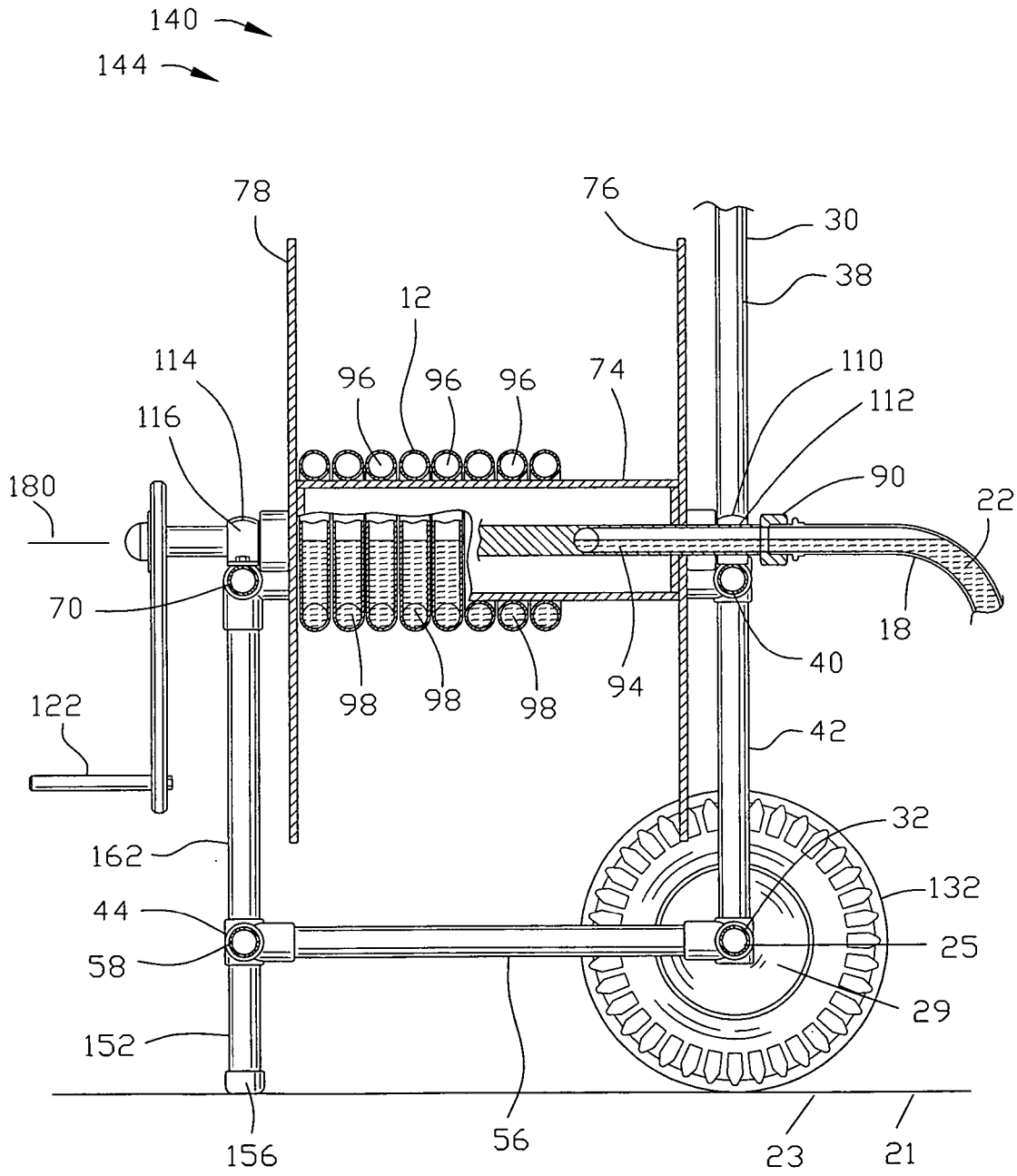
FIG. 11 is a sectional view along line 11-11 in FIG. 9.

As best seen in FIG. 11, if the hose reel device 10 has been utilized in the past, a portion of the first hose 12 may still include fluid 22 within the first hose 12. If the fluid 22 is positioned in the first hose 12 that remains wound around the hub 74, a plurality of air chambers 96 and a plurality of fluid chambers 98 may exist. If the holding tank 16 comprises a vessel holding tank or septic tank, the fluid 22 may include a liquid component 124 and a solid component 126. The combination of a liquid component 124 and a solid component 126 greatly increases the viscosity of the fluid 22. The combination of the plurality air chambers 96, plurality fluid chambers 98 and the increases in viscosity of the fluid 22 greatly increases the hydraulic loads on the pump 28 where a vacuum or reduced pressure is utilized. Therefore, FIG. 11 is not in optimal position for utilizing the hose reel device 10 for a vacuum or reduced pressure application.

Figure 10:
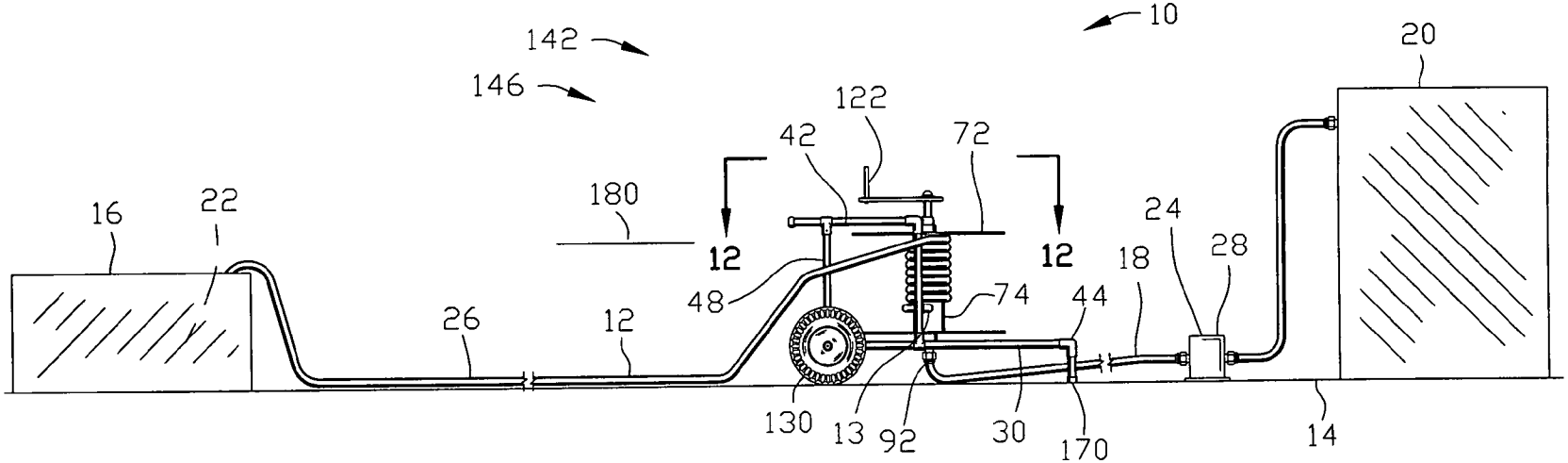
FIG. 10 is a side view similar to FIG. 9 illustrating the hose reel pivoted ninety degrees.
Figure 12:
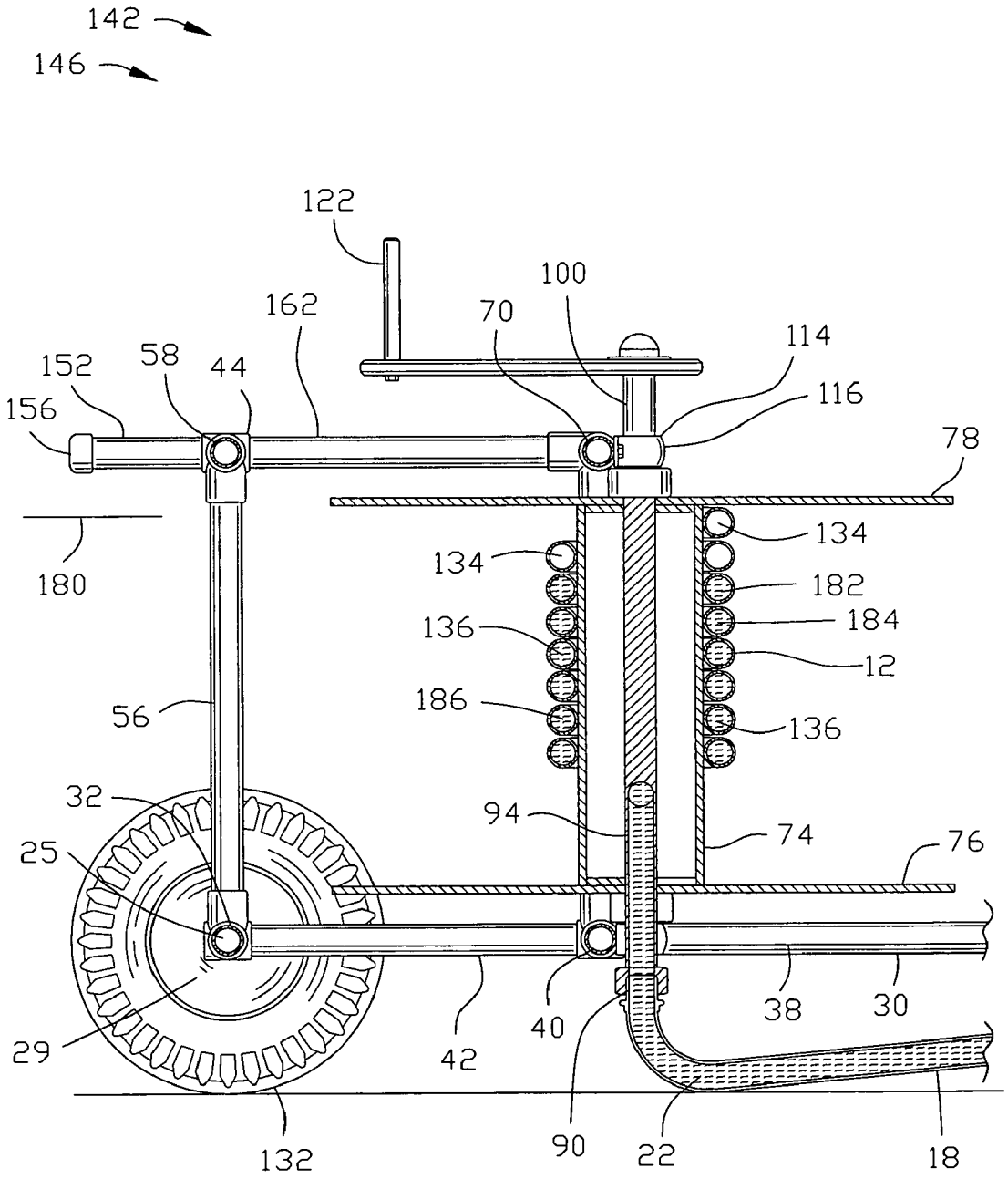
FIG. 12 is a sectional view along line 12-12 in FIG. 10.

FIGS. 10 and 12 illustrate the hose real device 10 positions in the vertical position 142. The vertical position 142 constitutes a second optimal position 146 for propelling the fluid 22 between the holding tank 16 and the storage tank 20. If the hose reel device 10 has been utilized in the past, a portion of the first hose 12 may still include fluid 22 within the first hose 12. If the fluid 22 is positioned in the first hose 12 that remains wound around the hub 74, a single air chamber 134 and a single fluid chamber 136 may exist. If the holding tank 16 comprises a vessel holding tank or septic tank, the fluid 22 may include a liquid component 124 and a solid component 126. The combination of a liquid component 124 and a solid component 126 greatly increases the viscosity of the fluid 22. The reduction of the plurality of air chambers 96 and the reduction of the plurality of fluid chambers 98 to a single air chamber 134 and a single fluid chamber 136 respectively, greatly decreases the hydraulic loads on the pump 28 where a vacuum or reduced pressure system is utilized. Therefore, FIG. 12 is an optimal position for utilizing the hose reel device 10 for a vacuum or reduced pressure application. Furthermore, the remaining first hose 12 that remains wound around the hub 74 serves to produce a coriolis effect 186 within the first hose 12. The coriolis effect 186 within the first hose 12 may further decrease the hydraulic loads on the pump 28 where a vacuum or reduced pressure system is utilized.

By utilizing the hose reel device 10 wherein the spool 72 is in the horizontal position 140 or the first optimal position 144, the hose 12 remaining on the spool 72 is in a vertical orientation where half of the hose 12 is below a hydraulic grade line 180 and half is above the hydraulic grade line 180 causing a pressure differential in the hose 12. The changing pressure throughout the first hose 12 remaining on the spool 72 prohibits the flow from achieving a constant flow.

By utilizing the hose reel device 10 wherein the spool 72 is in the vertical position 142 or the first optimal position 146, the elevation of the first hose 12 that remains wound around the hub 74 is below the hydraulic grade line 180 whereas the pressure is not differentiated and flow restriction is the same at all points on the first hose 12 remaining wound around the hub 74. By utilizing the hose reel device 10 wherein the spool 72 is in the vertical position 142 or the first optimal position 146, the flow through the first hose 12 remains constant and thereby increases the kinetic and potential energy as described in Bernoulli's Principle. In the same manner the orientation of the spool 72 and hub 74 as shown in FIGS. 8, 10 and 12, the first hose 12 remaining on hub 74 is oriented in a cylindrical shape around a vertical axis allowing the fluid to propel through the first hose 12 at a higher velocity generating a vortex effect 182. Furthermore, in the vertical position 142 of the spool 72, the majority of the first hose 12 that remains wound around the hub 74 is positioned below the hydraulic grade line 180 for producing a siphoning force 184 for reducing load and reducing load upon the pump 24. The advantage of utilizing the hose reel device 10 wherein spool 72 is in the vertical position 142 or first optimal position 146, enables the fluid 22 to be propelled through the first hose 12 and the hose reel device 10, with any length of first hose 12 remaining on hose reel device 10, while enabling maximum constant velocity and reducing load upon the pump 24.

In an alternative embodiment, the hose reel device 12 may be supported and pivoted over a base 21. The base 21 may include a truck bed 23. A pivot axle 25 couples the frame 30 to the base 21 for pivoting the spool 72 between the horizontal position 140 and the vertical position 142 relative to the base 21. The pivot axle 25 may be elevated above the base 21 by a first bracket 27 and a second bracket 29.

Hose Reel Test Parameters

The hose reel device 10 was utilized to conduct a first test set and second test set. A "new" positive displacement peristaltic pump 24 was tested to pull a vacuum of 29 in Hg (inches of mercury) at the time of the first test set and the second test set. The pump 24 was tested for vacuum capacity before and after each test set and the vacuum capacity was consistent showing that the pump 24 pulled a vacuum of 29 in Hg at all times tested. The pump 24 has a capacity of 15 gpm (gallons per minute) under normal conditions without head or friction loss to overcome. The first test set and second test set consisted of pulling water 22 of 1 SG (specific gravity) through different lengths of suction hose 12 on the spool 72. The spool 72 was in the horizontal position 140 as shown in FIGS. 1-6, 8, 9 and 11 for the first test set and in a vertical position 142 as shown in FIGS. 8, 10 and 12 for the second test set.

First Test Set Parameters & Results

The first test set included the spool 72 positioned in the horizontal position 140 as shown in FIGS. 1-6, 8, 9 and 11. By positioning the spool 72 in the horizontal position 140 results in placing the hose 12 in a vertical orientation.

Test One

Test One Parameters: One hundred feet of hose 12 on the spool 72,

Vacuum pump 24 ran for five minutes;

Test One Results: No fluid 22 was conveyed from the first hose 12, through the conduct 94 and out the second hose 18.

Test Two

Test Two Parameters: Fifty feet of hose 12 on the spool 72,

Vacuum pump 24 ran for five minutes;

Test Two Results: No fluid 22 was conveyed from the first hose 12, through the conduct 94 and out the second hose 18.

Test Three

Test Three Parameters: Thirty feet of hose 12 on the spool 72,

Vacuum pump 24 ran for five minutes;

Test Three Results: No fluid 22 was conveyed from the first hose 12, through the conduct 94 and out the second hose 18.

Test Four

Test Four Parameters: Fifteen feet of hose 12 on the spool 72,

Vacuum pump ran for 5 minutes,

Test Four Results: Forty-five (45) gallons was conveyed from the first hose 12, through the conduct 94 and out the second hose 18.

Rate of pumping was nine (9) gallons per minute. This is below the optimum pumping capacity of the pump used which is 15 gpm.

Second Test Set Parameters & Results

The second test set included the spool 72 positioned in the vertical position 142 as shown in FIGS. 8, 10 and 12. By positioning the spool 72 in the vertical position 142 results in placing the hose 12 in a horizontal orientation.

Test Five

Test Five Parameters: One hundred feet of hose 12 on the spool 72,

Vacuum pump 24 ran for three minutes;

Test Five Results: Forty-five (45) gallons was conveyed from the first hose 12, through the conduct 94 and out the second hose 18.

Test Six

Test Six Parameters: Fifty feet of hose 12 on the spool 72,

Vacuum pump 24 ran for three minutes;

Test Six Results: Forty-five (45) gallons was conveyed from the first hose 12, through the conduct 94 and out the second hose 18.

Test Seven

Test Seven Parameters: Thirty feet of hose 12 on the spool 72,

Vacuum pump 24 ran for three minutes;

Test Seven Results: Forty-five (45) gallons was conveyed from the first hose 12, through the conduct 94 and out the second hose 18.

Test Eight

Test Eight Parameters: Fifteen feet of hose 12 on the spool 72,

Vacuum pump ran for 3 minutes,

Test Eight Results: Forty-five (45) gallons was conveyed from the first hose 12, through the conduct 94 and out the second hose 18.

With the spool 72 positioned in the vertical position 142 water 22 was pumped at 15 gpm with lengths of hose 12 from 15 to 100 feet of 2 inch suction hose. This is the optimum pumping capacity of the pump 24 used for the test.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A hose reel device for supporting and transporting a first hose over a surface, the first hose extending between a holding tank and the hose reel device, a second hose extending between the hose reel device and a storage tank, the holding tank housing a fluid, a pump engaging the fluid for propelling the fluid between the holding tank and the storage tank, the hose reel device, comprising:

a frame including a lower beam, an upper beam, a first coupling beam interposed between said lower beam and said upper beam and a second coupling beam interposed between said lower beam and said upper beam;

a support beam extending within said frame;

a spool including a hub interposed between a first flange plate and a second flange plate for winding the first hose on said spool;

said hub of said spool rotatably engaging said support beam for rotating said spool relative to said frame;

said hub including a cylindrical body for defining an interior bore extending between said first flange plate and said second flange plate;

a hose input traversing said hub of said spool for engaging the first hose;

a hose output traversing said first flange plate for engaging the second hose;

a conduit extending through said interior bore of said cylindrical bore and coupling said hose input and said hose output for conveying the fluid between the first hose and the second hose;

said hub of said spool and said frame defining a perpendicular angle;

a wheel rotatably engaging said lower beam for transporting the hose reel device over the surface in an oblique position and pivoting said spool between a horizontal position and a vertical position relative to the surface;

a second wheel rotatably engages said lower beam for transporting the hose reel device over the surface and pivoting said spool between a horizontal position and a vertical position relative to the surface;

a first handle extends from said upper beam for griping said frame and supporting said frame when said spool in said vertical position relative to the surface;

a second handle extends from said upper beam for griping said frame and supporting said frame when said spool in said vertical position relative to the surface;

a lower ledge extends from said lower beam;

said lower ledge including a first ledge beam, a second ledge beam and a coupling ledge beam interposed between said first ledge beam and said second ledge beam;

said lower ledge and said frame defining a generally L-shape;

a first leg extending from said lower ledge for supporting said lower ledge above the surface;

a second leg extending from said lower ledge for supporting said lower ledge above the surface;

said first wheel and said second wheel in combination with said first leg and said second leg engaging the surface for defining a first optimal position wherein said spool defines said horizontal position;

said first handle and said second handle cooperating with said first wheel and said second wheel for transporting said spool over the surface in said oblique position;

said first wheel and said second wheel in combination with said first handle and said second handle engaging the surface for defining a second optimal position wherein said spool defines said vertical position;

said second optimal position locating said hose input in a generally adjacent and an ascend position relative to said first flange plate for defining a lower input level; and said second optimal position locating said hose output in a generally adjacent and a descend position relative to said frame for defining a lowest output level.

2. The hose reel device for supporting and transporting a first hose over a surface as set forth in claim 1, wherein said handle including a polymer cap for increasing the friction coefficient between said handle and the surface to prevent displacement of the hose reel device relative to the surface when said spool is positioned in said vertical position; and said second handle including a polymer cap for increasing the friction coefficient between said handle and the surface to prevent displacement of the hose reel device relative to the surface when said spool is positioned in said vertical position.

3. The hose reel device for supporting and transporting a first hose over a surface as set forth in claim 1, wherein a spool handle secured to said second flange plate of said spool for rotating said spool relative to said frame.

4. The hose reel device for supporting and transporting a first hose over a surface as set forth in claim 1, wherein said first leg includes a polymer cap for increasing the friction coefficient between said first leg and the surface to prevent displacement of the hose reel device relative to the surface when said spool is positioned in said horizontal position; and said second leg includes a polymer cap for increasing the friction coefficient between said second leg and the surface to prevent displacement of the hose reel device relative to the surface when said spool is positioned in said horizontal position.

5. The hose reel device for supporting and transporting a first hose over a surface as set forth in claim 1, wherein an upper ledge extends from said frame;

said upper ledge including a first ledge beam, a second ledge beam and a coupling ledge beam interposed between said first ledge beam and said second ledge beam;

said frame, said support beam and said upper ledge defining a generally L-shape;

a first bearing secured to said support beam;

a second bearing secured to said coupling ledge beam;

said first bearing and said second bearing defining a concentric alignment;

a spool axle traversing between said first bearing and said second bearing for rotating said spool axle relative to said frame; and said spool axle traversing said hub of said spool for rotating said spool upon rotation of said spool axle.

6. The hose reel device for supporting and transporting a first hose over a surface as set forth in claim 1, wherein an upper ledge extends from said frame;

said upper ledge including a first upper ledge beam, a second upper ledge beam and a upper coupling ledge beam interposed between said first upper ledge beam and said second upper ledge beam; and said frame, said support beam and said upper ledge defining a second generally L-shape;

a first bearing secured to said support beam;

a second bearing secured to said upper coupling ledge beam;

said first bearing and said second bearing defining a concentric alignment;

a spool axle traversing between said first bearing and said second bearing for rotating said spool axle relative to said frame;

said spool axle traversing said hub of said spool for rotating said spool upon rotation of said spool axle;

a first column extending between said upper ledge to said lower ledge for transmitting a vertical load of said spool from said upper ledge through said first leg and to the surface when said spool is positioned in said second optimal position; and a second column extending between said upper ledge to said lower ledge for transmitting a vertical load of said spool from said upper ledge through said second leg and to the surface when said spool is positioned in said second optimal position.

7. A hose reel device for supporting and transporting a first hose over a surface, the first hose extending between a holding tank and the hose reel device, a second hose extending between the hose reel device and a storage tank, the holding tank housing a fluid, a pump engaging the fluid for propelling the fluid between the holding tank and the storage tank, the hose reel device, comprising:

a frame including a lower beam, an upper beam, a first coupling beam interposed between said lower beam and said upper beam and a second coupling beam interposed between said lower beam and said upper beam;

a support beam extending within said frame;

a spool including a hub interposed between a first flange plate and a second flange plate for winding the first hose on said spool;

said hub of said spool rotatably engaging said support beam for rotating said spool relative to said frame;

a hose input traversing said hub of said spool for engaging the first hose;

a hose output traversing said first flange plate for engaging the second hose;

a conduit extending through said interior bore of said cylindrical bore and coupling said hose input and said hose output for conveying the fluid between the first hose and the second hose;

said hub of said spool and said frame defining a perpendicular angle;

a wheel rotatably engaging said lower beam for transporting the hose reel device over the surface in an oblique position and pivoting said spool between a horizontal position and a vertical position relative to the surface;

a second wheel rotatably engaging said lower beam for transporting the hose reel device over the surface and pivoting said spool between a horizontal position and a vertical position relative to the surface;

a handle extending from said upper beam for griping said frame and supporting said frame when said spool in said vertical position relative to the surface;

said handle including a polymer cap for increasing the friction coefficient between said handle and the surface to prevent displacement of the hose reel device relative to the surface when said spool is positioned in said vertical position;

a spool handle securing to said second flange plate of said spool for rotating said spool relative to said frame;

a ledge extending from said lower beam;

said ledge including a first ledge beam, a second ledge beam and a coupling ledge beam interposed between said first ledge beam and said second ledge beam; and said ledge and said frame defining a generally L-shape;

a leg extending from said ledge for supporting said ledge above the surface;

said first wheel and said second wheel in combination with said leg engaging the surface for defining a first optimal position wherein said spool defines said horizontal position;

said handle cooperating with said first wheel and said second wheel for transporting said spool over the surface in said oblique position;

said first wheel and said second wheel in combination with said handle engaging the surface for defining a second optimal position wherein said spool defines said vertical position;

said second optimal position locating said hose input in a generally adjacent and an ascend position relative to said first flange plate for defining a lower input level; and said second optimal position locating said hose output in a generally adjacent and a descend position relative to said frame for defining a lowest output level.

8. A hose reel device for supporting and transporting a first hose over a surface, the first hose extending between a holding tank and the hose reel device, a second hose extending between the hose reel device and a storage tank, the holding tank housing a fluid, a pump engaging the fluid for propelling the fluid between the holding tank and the storage tank, the hose reel device, comprising:

a frame including a lower beam, an upper beam, a first coupling beam interposed between said lower beam and said upper beam and a second coupling beam interposed between said lower beam and said upper beam;

a support beam extending within said frame;

a spool including a hub interposed between a first flange plate and a second flange plate for winding the first hose on said spool;

said hub of said spool rotatably engaging said support beam for rotating said spool relative to said frame;

a hose input traversing said hub of said spool for engaging the first hose;

a hose output traversing said first flange plate for engaging the second hose;

a conduit extending between said hose input and said hose output for conveying the fluid between the first hose and the second hose;

said hub of said spool and said frame defining a perpendicular angle;

a wheel rotatably engaging said lower beam for transporting the hose reel device over the surface in an oblique position and pivoting said spool between a horizontal position and a vertical position relative to the surface;

a handle extending from said upper beam for griping said frame and supporting said frame when said spool in said vertical position relative to the surface;

a lower ledge extends from said lower beam;

said lower ledge including a first lower ledge beam, a second lower ledge beam and a lower coupling Ledge beam interposed between said first lower ledge beam and said second lower ledge beam;

said lower ledge and said frame defining a first generally L-shape;

an upper ledge extends from said frame;

said upper ledge including a first upper ledge beam, a second upper ledge beam and a upper coupling ledge beam interposed between said first upper ledge beam and said second upper ledge beam;

said frame, said support beam and said upper ledge defining a second generally L-shape;

a first bearing secured to said support beam;

a second bearing secured to said upper coupling ledge beam;

said first bearing and said second bearing defining a concentric alignment;

a spool axle traversing between said first bearing and said second bearing for rotating said spool axle relative to said frame;

said spool axle traversing said hub of said spool for rotating said spool upon rotation of said spool axle;

a leg extending from said lower ledge for supporting said spool above the surface;

said leg and said ledge defining a perpendicular angle;

said wheel in combination with said leg engaging the surface for defining a first optimal position wherein said spool defines said horizontal position;

said handle cooperating with said first wheel and said second wheel for transporting said spool over the surface in said oblique position;

said first wheel and said second wheel in combination with said handle engaging the surface for defining a second optimal position wherein said spool defines said vertical position;

a first column extending between said upper ledge to said lower ledge for transmitting a vertical load of said spool from said upper ledge through said first leg and to the surface when said spool is positioned in said second optimal position; and a second column extending between said upper ledge to said lower ledge for transmitting a vertical load of said spool from said upper ledge through said second leg and to the surface when said spool is positioned in said second optimal position.

9. A hose reel device for supporting a first hose over a base, the first hose extending between a holding tank and the hose reel device, a second hose extending between the hose reel device and a storage tank, the holding tank housing a fluid, a pump engaging the fluid for propelling the fluid between the holding tank and the storage tank, the hose reel device, comprising:

a frame including a lower beam, an upper beam, a first coupling beam interposed between said lower beam and said upper beam and a second coupling beam interposed between said lower beam and said upper beam;

a support beam extending within said frame;

a spool including a hub interposed between a first flange plate and a second flange plate for winding the first hose on said spool;

said hub of said spool rotatably engaging said support beam for rotating said spool relative to said frame;

said hub including a cylindrical body for defining an interior bore extending between said first flange plate and said second flange plate;

a hose input traversing said hub of said spool for engaging the first hose;

a hose output traversing said first flange plate for engaging the second hose;

a conduit extending through said interior bore of said cylindrical bore and coupling said hose input and said hose output for conveying the fluid between the first hose and the second hose;

said hub of said spool and said frame defining a perpendicular angle;

a pivot engaging said lower beam for pivoting said spool between a horizontal position and a vertical position relative to the base;

a first handle extends from said upper beam for griping said frame and supporting said frame when said spool in said vertical position relative to the base;

a second handle extends from said upper beam for griping said frame and supporting said frame when said spool in said vertical position relative to the base;

a lower ledge extends from said lower beam;

said lower ledge including a first ledge beam, a second ledge beam and a coupling ledge beam interposed between said first ledge beam and said second ledge beam;

said lower ledge and said frame defining a generally L—shape;

a first leg extending from said lower ledge for supporting said lower ledge above the base;

a second leg extending from said lower ledge for supporting said lower ledge above the base;

said pivot in combination with said first leg and said second leg engaging the base for defining a first optimal position wherein said spool defines said horizontal position;

said pivot in combination with said first handle and said second handle engaging the base for defining a second optimal position wherein said spool defines said vertical position;

said second optimal position locating said hose input in a generally adjacent and an ascend position relative to said first flange plate for defining a lower input level; and said second optimal position locating said hose output in a generally adjacent and a descend position relative to said frame for defining a lowest output level.

10. The hose reel device for supporting a first hose over a base as set forth in claim 9, further including a second pivot engaging said lower beam for pivoting said spool between a horizontal position and a vertical position relative to the base;

said second pivot in combination with said first leg and said second leg engaging the base for defining said first optimal position wherein said spool defines said horizontal position; and said second pivot in combination with said first handle and said second handle engaging the base for defining said second optimal position wherein said spool defines said vertical position.

11. A hose reel device for supporting a first hose over a base, the first hose extending between a holding tank and the hose reel device, a second hose extending between the hose reel device and a storage tank, the holding tank housing a fluid, a pump engaging the fluid for propelling the fluid between the holding tank and the storage tank, the hose reel device, comprising:

a frame including a lower beam, an upper beam, a first coupling beam interposed between said lower beam and said upper beam and a second coupling beam interposed between said lower beam and said upper beam;

a support beam extending within said frame;

a spool including a hub interposed between a first flange plate and a second flange plate for winding the first hose on said spool;

said hub of said spool rotatably engaging said support beam for rotating said spool relative to said frame;

said hub including a cylindrical body for defining an interior bore extending between said first flange plate and said second flange plate;

a hose input traversing said hub of said spool for engaging the first hose;

a hose output traversing said first flange plate for engaging the second hose;

a conduit extending through said interior bore of said cylindrical bore and coupling said hose input and said hose output for conveying the fluid between the first hose and the second hose;

said hub of said spool and said frame defining a perpendicular angle;

a pivot axle engaging said lower beam for pivoting said spool between a horizontal position and a vertical position relative to the base;

a first handle extends from said upper beam for griping said frame and supporting said frame when said spool in said vertical position relative to the base;

a second handle extends from said upper beam for griping said frame and supporting said frame when said spool in said vertical position relative to the base;

a lower ledge extends from said lower beam;

said lower ledge including a first ledge beam, a second ledge beam and a coupling ledge beam interposed between said first ledge beam and said second ledge beam;

said lower ledge and said frame defining a generally L—shape;

a first leg extending from said lower ledge for supporting said lower ledge above the base;

a second leg extending from said lower ledge for supporting said lower ledge above the base;

said pivot axle in combination with said first leg and said second leg engaging the base for defining a first optimal position wherein said spool defines said horizontal position;

said pivot axle in combination with said first handle and said second handle engaging the base for defining a second optimal position wherein said spool defines said vertical position;

said second optimal position locating said hose input in a generally adjacent and an ascend position relative to said first flange plate for defining a lower input level; and said second optimal position locating said hose output in a generally adjacent and a descend position relative to said frame for defining a lowest output level.

12. A hose reel device for supporting a first hose over a base, the first hose extending between a holding tank and the hose reel device, a second hose extending between the hose reel device and a storage tank, the holding tank housing a fluid, a pump engaging the fluid for propelling the fluid between the holding tank and the storage tank, the hose reel device, comprising:

a frame including a lower beam, an upper beam, a first coupling beam interposed between said lower beam and said upper beam and a second coupling beam interposed between said lower beam and said upper beam;

a support beam extending within said frame;

a spool including a hub interposed between a first flange plate and a second flange plate for winding the first hose on said spool;

said hub of said spool rotatably engaging said support beam for rotating said spool relative to said frame;

said hub including a cylindrical body for defining an interior bore extending between said first flange plate and said second flange plate;

a hose input traversing said hub of said spool for engaging the first hose;

a hose output traversing said first flange plate for engaging the second hose;

a conduit coupling to said spool and defining a parallel orientation relative to said hub;

said conduit coupling said hose input and said hose output for conveying the fluid between the first hose and the second hose;

said hub of said spool and said frame defining a perpendicular angle;

a pivot engaging said lower beam for pivoting said spool between a horizontal position and a vertical position relative to the base;

a first handle extends from said upper beam for griping said frame and supporting said frame when said spool in said vertical position relative to the base;

a second handle extends from said upper beam for griping said frame and supporting said frame when said spool in said vertical position relative to the base;

a lower ledge extends from said lower beam;

said lower ledge including a first ledge beam, a second ledge beam and a coupling ledge beam interposed between said first ledge beam and said second ledge beam;

said lower ledge and said frame defining a generally L—shape;

a first leg extending from said lower ledge for supporting said lower ledge above the base;

a second leg extending from said lower ledge for supporting said lower ledge above the base;

said pivot in combination with said first leg and said second leg engaging the base for defining a first optimal position wherein said spool defines said horizontal position;

said pivot in combination with said first handle and said second handle engaging the base for defining a second optimal position wherein said spool defines said vertical position;

said second optimal position locating said hose input in a generally adjacent and an ascend position relative to said first flange plate for defining a lower input level; and said second optimal position locating said hose output in a generally adjacent and a descend position relative to said frame for defining a lowest output level.

13. The hose reel device for supporting a first hose over a base as set forth in claim 12, further including a pressure gauge coupled to said vacuum pump for measuring a first vacuum pressure created by the pump in said first optimal position and measuring a second vacuum pressure created by the pump in said second optimal position.

* * * * *